United States Patent [19]

Prada

[11] 4,300,025

[45] Nov. 10, 1981

[54] REFRIGERATOR DOOR SWITCH

[75] Inventor: Luis E. Prada, Louisville, Ky.

[73] Assignee: General Electric Company, Louisville, Ky.

[21] Appl. No.: 101,946

[22] Filed: Dec. 10, 1979

[51] Int. Cl.[3] ..... H01H 3/16

[52] U.S. Cl. ..... 200/61.69; 200/67 DB; 200/283

[58] Field of Search ..... 200/61.69, 61.82, 61.62, 200/61.7, 61.76, 61.81, 67 DB, 283

[56] References Cited

U.S. PATENT DOCUMENTS

| | | | |
|---|---|---|---|
| 1,876,829 | 9/1932 | Avakian | 200/61.27 |
| 2,246,676 | 6/1941 | Hainsworth | 62/89 |
| 2,408,213 | 9/1946 | Huber | 200/61.69 |
| 3,067,301 | 12/1962 | Yamamoto | 200/67 DB |
| 3,151,224 | 9/1964 | Colucci | 200/61.69 X |
| 3,428,766 | 2/1969 | Kaufman | 200/61.69 |
| 3,819,896 | 6/1974 | Aidn et al. | 200/283 |
| 3,881,077 | 4/1975 | Piber | 200/61.69 |
| 3,887,777 | 6/1975 | Nishino | 200/61.69 |
| 3,895,198 | 7/1975 | Piber | 200/61.76 |

*Primary Examiner*—J. V. Truhe
*Assistant Examiner*—Morris Ginsburg
*Attorney, Agent, or Firm*—Frank P. Giacalone; Radford M. Reams

[57] ABSTRACT

A switch operable by either one or both of two adjacent doors of a two-door refrigerator-freezer to control the lights therein. When both doors are closed, the lights in both compartments are deenergized and when either or both doors is open, the lights in either or both are energized respectively.

3 Claims, 7 Drawing Figures

REFRIGERATOR DOOR SWITCH

BACKGROUND OF THE INVENTION

This invention relates generally to door switches and, more particularly, to door switches for use in refrigerators having fresh food and freezing compartments. It is common practice to have a convenience lamp illuminate the compartments when a door is open. Two-door switches have been known heretofore. However, the prior switches of this type involved certain disadvantages, such as special mounting space, modification of the doors, special mounting apparatus, difficult to install and costly. While those prior switches have been useful for their intended purpose, this invention relates to improvements thereover.

SUMMARY OF THE INVENTION

It is an object of the present invention to provide unitary switch operable by the doors of a double door cabinet. The switch comprises a housing, including a central portion and a cross portion. The housing is dimensioned for mounting on the cabinet in a position associated with adjacent inner edge portions of the doors.

A switch is positioned within the central portion of the housing and includes a central common contact member and a first and second movable switch contact member arranged on either side of the central contact. The first and second movable contact members include portions extending beyond one distal end of said central contact member.

There is provided a cross member that is arranged in the cross portion of the housing and includes at least two push buttons mounted on opposite end portions thereon and extending from the member through the housing for engagement by the adjacent edge portions of the doors.

Aligned with each of the buttons are springs for maintaining the buttons in their extended position relating to the housing.

Formed on and projecting from the cross member is a switch actuating member, including cam face means, extending to a position interposed between the extending portions of the first and second movable switch contact means.

The cross member is pivotally arranged about the projection with the projection slidably arranged on the pivot for causing the projection to move both first and second switch means when both buttons are engaged by the doors and for alternatively moving one or the other switch means in response to the opening of one or the other of the doors.

DESCRIPTION OF THE PREFERRED EMBODIMENT

Figure 1:
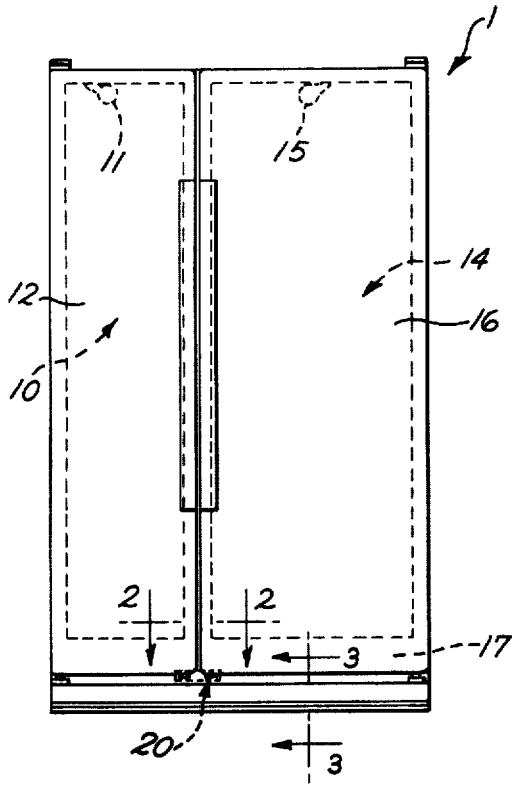
FIG. 1 is a front view of a refrigerator having a freezer chamber wherein a door switch is installed to be associated with the doors of each chamber.
Figure 2:
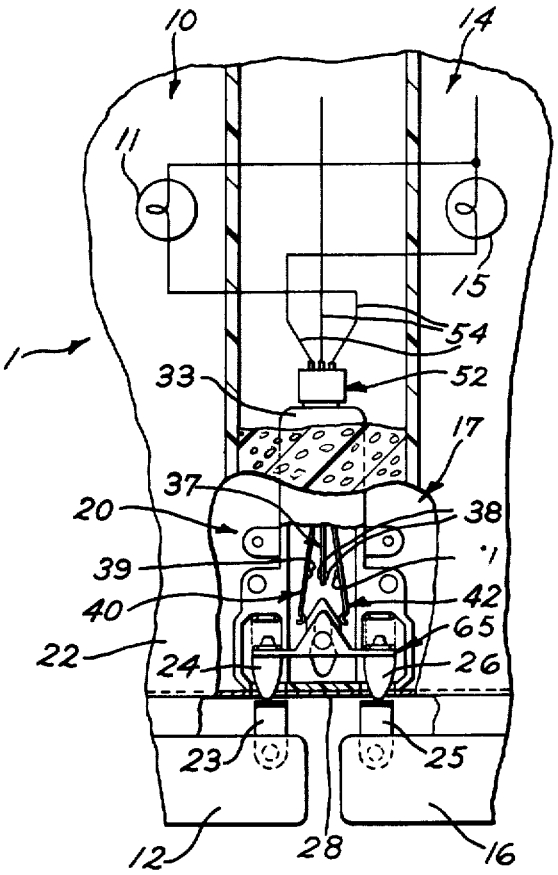
FIG. 2 is a plan view of the switch taken along lines 2—2 of FIG. 1 with parts broken away, showing the switch in one operation.
Figure 3:
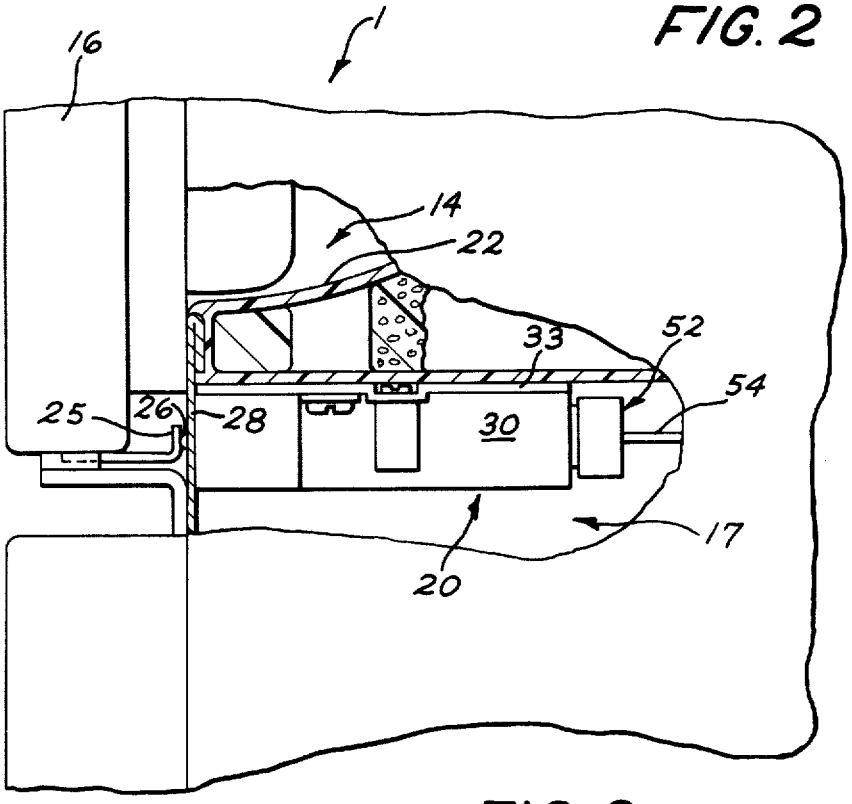
FIG. 3 is a side elevational view of the switch taken along lines 3—3 of FIG. 1.
Figure 4:
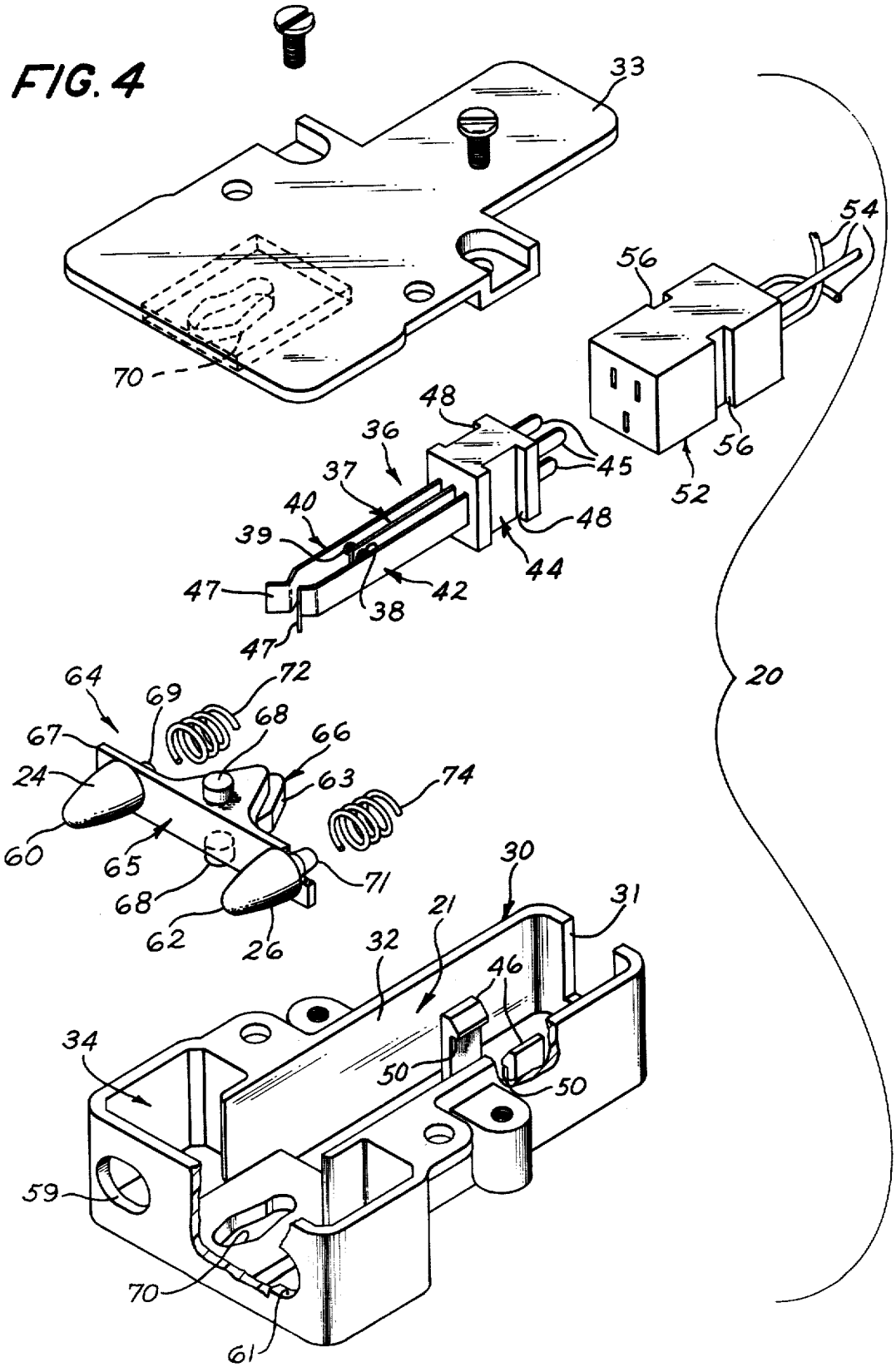
FIG. 4 is a perspective view of a door switch according to the present invention.
Figure 5:
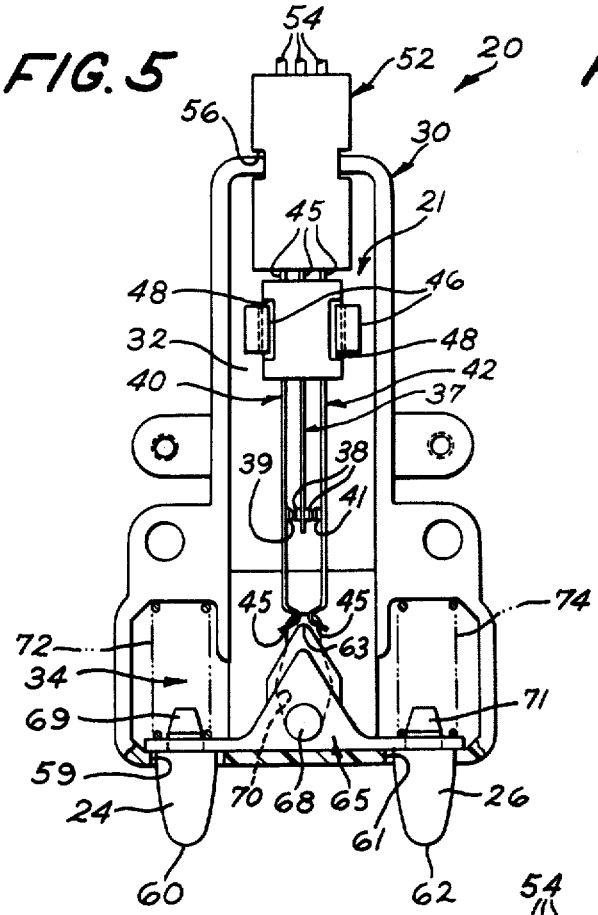
FIG. 5 is a view similar to FIG. 2 showing the switch in another operation.
Figure 6:
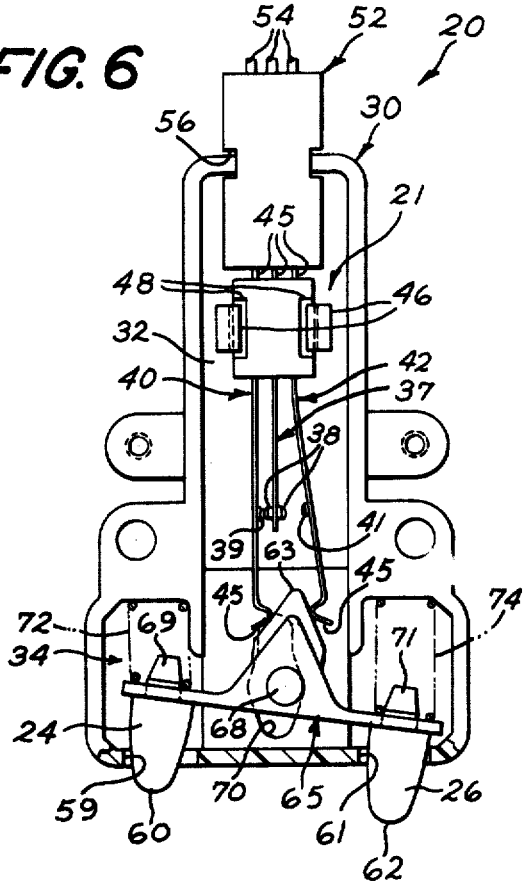
FIG. 6 is a view similar to FIG. 2 showing the switch in another operation.
Figure 7:
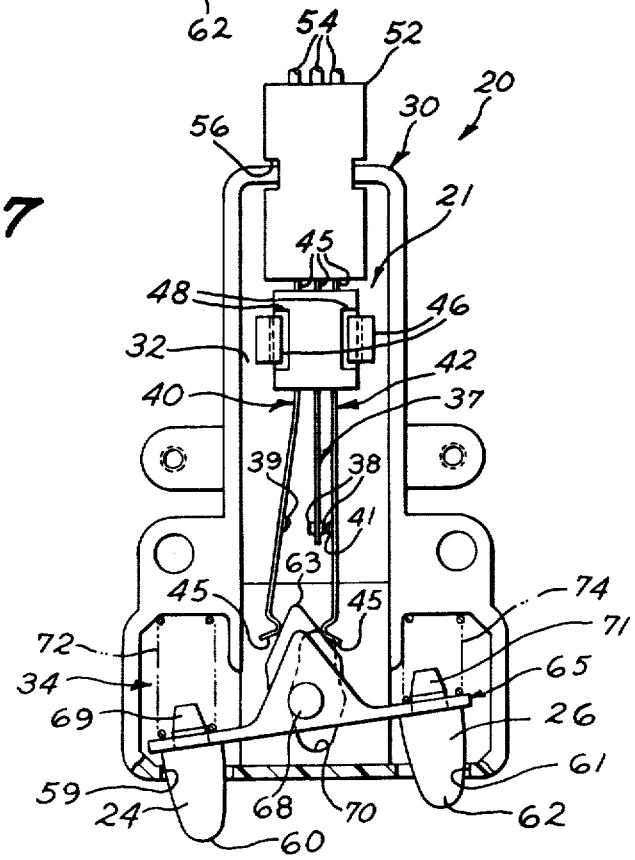
FIG. 7 is a view similar to FIG. 2 showing the switch in still another operation.

Referring to FIG. 1, there is shown a two-door side-by-side refrigerator freezer cabinet 1, including a freezer compartment 10 and freezer door 12, a fresh food compartment 14 and door 16, and a machine compartment 17 located below the compartments. Positioned in the compartments 10 and 14 are lamps 11 and 15 respectively. The present switch 20 constructed in accordance with the invention is shown positioned between the lower inner corner portions of the doors 12 and 16. While the switch may have different applications, its preferred use is shown as being applied to an upright side-by-side two-door refrigerator-freezer and, more specifically, to control the lights therein. The switch 20 is adapted to open the lamp circuits when both doors are closed, as shown in FIG. 2. When either door is open, or both, the switch closes the lamp circuits to those lamps having their respective doors open and illuminates the lamp or lamps, as shown in FIGS. 5–7. When either door is closed, as shown in FIGS. 6 and 7, or both, as shown in FIG. 2, the switch opens the lamp circuits to those lamps having their respective doors closed. The switch 20, as shown in FIG. 3, is mounted in the machine compartment 17 generally in the lower mullion area 22 so that its actuating members or push buttons 24 and 26 project beyond the mullion wall 28 so as to contact brackets 23 and 25 mounted on the inner corner portions of the doors 12 and 16. In this position, the switch 20 may be easily installed or replaced.

The switch assembly 20 (FIG. 4) comprises a housing 30 that includes a generally T-shaped recess 21. The T-shaped recess 21 includes a central or main portion 32 terminating at one end, with an opening 31 located at the rear portion of switch 20. The other end of portion 32 communicates with a cross portion 34 disposed substantially perpendicular thereto. A cover member 33 is provided for sealing housing 30, including portions 32 and 34 of recess 21. A switch assembly 36 is adapted to be arranged in the central portion 32 of housing 30, as shown in FIGS. 4–7. This switch assembly includes a stationary central or common member 37 and a pair of movable members 40 and 42. The members 40,42 are positioned on either side of member 37 and are substantially parallel thereto. The central member 37 carries contacts 38 located on each face opposite the members 40,42. The members 40,42 are provided with contacts 39 and 41, respectively, that cooperatively engage contacts 38 of member 37. The members 40 and 42 in their normal free standing position, as shown in FIG. 5 with both doors 12 and 16 open and both buttons in their extended position, are biased so that the contacts 39 and 41 engage their respective contacts 38 on member 37.

Means are provided for selectively moving members 40,42 relative to central portion 37 so that the lamp 15 in the fresh food compartment is controlled through contacts 38,41, while the lamp 11 in the freezer compartment is controlled through contacts 38,39 as shown in FIG. 2. In the present embodiment shown, the members 40 and 42 are longer than central member 37 and extend beyond its free end. The free ends or extending portions of members 40,42 include cam faces 47. A portion of members 37, 40 and 42 is encapsulated in an insulating block 44 with terminal ends 45 extending therethrough. The block 44 is dimensioned to be securely held in the portion 32 by a pair of arms 46 formed on the bottom wall of portion 32. The arms 46 are received in grooves 48 formed in block 44 and include latch portions that snap over and engage the upper surface of the block 44, as shown in FIGS. 5–7 of the drawing. The terminal ends 45 of the assembly 36 plug into a block 52. The block 52 includes wires 54 that are part of the circuits for lamps 11 and 15, as shown in FIG. 2. The block 52 has grooves 56 formed on opposite sides that engage the wall portions of opening 31 at the end of central portion 32 of housing 30.

The buttons 24 and 26, as shown in the drawings, are positioned so as to project through openings 59 and 61, respectively, in the cross portion 34 of housing 30. A movable swing piece or cross member assembly 64 is positioned in the cross portion 34 of housing 30. Generally, the assembly 64 includes a T-shaped member 65, including cross member 67, and a switch actuating projection or leg member 66. The switch actuating member 66 includes a cam portion 63 that is positioned between faces 47. The buttons 24 and 26 are mounted adjacent each of the end portions of member 67 and include a door contacting portion 60 and 62 respectively that, as mentioned hereinbefore, extend through housing 30 and mullion wall 28. The opposite end of the buttons 24 and 26 extend through the opposite side of member 67 and include spring locating pins 69 and 71 respectively.

Referring now to FIGS. 4–7, it will be seen that the cross member 64 and buttons 24 and 26 are held or biased in their extended position by a pair of springs 72 and 74 respectively. The springs are located on the projection or pins 69 and 71 formed as part of buttons 24 and 26 and are positioned in compression between the backside of cross member 64 and the inner wall portion or cross housing 34. The leg member 66 is provided with pivots 68 that extend from the upper and lower walls. The pivots 68 are arranged in elongated openings 70 in the bottom wall of housing 30 and cover member 33. The openings 70 are dimensioned to allow pivoting or rotational movement of member 65 when one of the buttons 24,26 is displaced by movement of the doors relative to each other. However, when the doors are both either opened or closed, the members 65, through its pivots 60 and elongated openings 70, will move longitudinally. As shown in FIG. 2, when both doors are closed, the buttons are held in their retracted position against action of the springs, the cross member, including the switch actuator 66, moves longitudinally toward the central portion 32 of housing 30. This longitudinal movement causes the actuator 66 and, more particularly, cam portion 63 to be positioned between the cam faces 47 and, accordingly, to move both the members 40 and 42 away from the central contact member 37. In this position, the circuit is open to both the freezer and fresh food compartment lamp.

In the position shown in FIG. 5, both doors are open, the buttons are both extended and member 65 moves longitudinally outwardly with the switch actuating member 66 and cam portion 63 moving away from cam faces 47 so that both switch members close a circuit to their respective lamps. FIG. 6 shows the fresh food door in its open position with its switch member 40 closed to fresh food compartment lamp 15. As shown in this door position, the member 65 rotates so that the switch actuating cam member 63 will engage only cam surface 47 on member 42 to open or maintain the circuit to freezer lamp 11 open. FIG. 7 shows the freezer door in its open position with its switch member 42 closed to freezer compartment lamp 11. As shown in this door position, the member 65 rotates so that the switch actuating cam member 63 will engage only cam surface 45 on member 40 to open or maintain the circuit to fresh food lamp 15 open.

It should be apparent to those skilled in the art that the embodiment described heretofore is considered to be presently preferred form of this invention. In accordance with the Patent Statutes, changes may be made in the disclosed apparatus and the manner in which it is used without actually departing from the true spirit and scope of this invention.

What is claimed is:

1. A unitary switch operable by the doors of a double door cabinet comprising:

a housing, including a central portion and a cross portion member, arranged for mounting on the cabinet in a position associated with adjacent edge portions of the doors;

a switch contact within said central portion housing having a central common contact means and a first and second movable switch contact means arranged on either side of said central contact means for engagement therewith;

a cross member arranged in said cross portion member having at least two push buttons mounted on opposite end portions there-on with each of said buttons extending from said member through said housing for engagement by the edges of the doors;

biasing means located in said cross member being aligned with each of said buttons and positioned between said cross member and said cross portion for maintaining said buttons in their extended position relative to the housing;

a switch actuating projection on said cross member extending from said member interposed between said first and second movable switch contact means for engaging said first and second movable switch contact means respectively; and pivot means between said housing and said cross member dimensioned to allow rotational movement of said cross member about said projection with said projection slidably arranged on said pivot means for causing said projection to move both of said first and second switch contact means when both of said buttons are engaged by said doors and for alternatively moving one or the other of said switch contact means in response to the opening of one or the other of said doors.

2. The invention recited in claim 1 further comprising: said first and second movable contact means each including portions extending beyond one distal end of said central contact means; and cam face means on each of said extending portions of said movable contact means being engageable by said switch actuating projection.

3. The invention recited in claim 2 further comprising cam switch actuating means on said switch actuating projection being arranged between said cam face means on said extending portions of said movable contact means.

* * * * *